US008034276B2

(12) United States Patent
Welch

(10) Patent No.: US 8,034,276 B2
(45) Date of Patent: Oct. 11, 2011

(54) PUMP HOUSING FOR A DOMESTIC APPLIANCE

(75) Inventor: Rodney M. Welch, Beach Bluff, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1250 days.

(21) Appl. No.: 11/716,001

(22) Filed: Mar. 9, 2007

(65) Prior Publication Data

US 2007/0246089 A1 Oct. 25, 2007

Related U.S. Application Data

(60) Provisional application No. 60/793,247, filed on Apr. 20, 2006.

(51) Int. Cl.
*B29C 45/14* (2006.01)

(52) U.S. Cl. ..... 264/279; 264/255; 264/259; 264/271.1; 134/184

(58) Field of Classification Search ..... 264/255, 264/259, 271.1, 279; 134/184
See application file for complete search history.

(56) References Cited

U.S. PATENT DOCUMENTS

| | | | | |
|---|---|---|---|---|
| 2,733,479 | A * | 2/1956 | English | 249/68 |
| 2,880,740 | A * | 4/1959 | Peglow | 134/188 |
| RE24,909 | E | 12/1960 | Dochterman | |
| 3,851,993 | A * | 12/1974 | Foster | 415/52.1 |
| 4,306,841 | A | 12/1981 | Morrison et al. | |
| 4,467,627 | A | 8/1984 | Platt et al. | |
| 4,806,083 | A | 2/1989 | LaGrange et al. | |
| 5,055,006 | A | 10/1991 | Kobayashi et al. | |
| 5,794,670 | A * | 8/1998 | LaFleur | 141/314 |
| 5,895,695 | A | 4/1999 | Rowley | |
| 6,530,758 | B1 | 3/2003 | Ritter et al. | |
| 6,931,891 | B2 | 8/2005 | Killane | |
| 2005/0284505 | A1 | 12/2005 | Bang | |

FOREIGN PATENT DOCUMENTS

| | | | |
|---|---|---|---|
| EP | 992704 | A2 * | 4/2000 |
| FR | 2053996 | A | 4/1971 |
| GB | 1256390 | A | 12/1971 |
| JP | 410281096 | | 10/1998 |
| KR | 2001077128 | * | 8/2001 |
| WO | 00/16681 | A | 3/2000 |

OTHER PUBLICATIONS

Translation of KR 2001077128 abstract.*

* cited by examiner

*Primary Examiner* — Richard Crispino
*Assistant Examiner* — Elizabeth Royston
(74) *Attorney, Agent, or Firm* — Robert A. Bacon; Diederiks & Whitelaw PLC

(57) ABSTRACT

A domestic appliance includes a pump that establishes and directs a flow of washing fluid into a tub during a washing operation. The pump includes a pump housing having a rigid main body portion that defines an inlet section and an outlet section, as well as a plurality of resilient members that are over-molded onto the inlet and outlet sections. The rigid main body portion includes a mounting element for supporting the pump. An insulation grommet is positioned in the mounting element to minimize any transfer of vibration from the pump to the appliance. The inlet nipple, outlet nipple and insulation grommet are joined through a plurality of web members. The rigid main body also includes a secondary outlet section that is adapted to directly receive a hose or is connected to a hose through a secondary outlet nipple.

11 Claims, 9 Drawing Sheets

PUMP HOUSING FOR A DOMESTIC APPLIANCE

CROSS-REFERENCE TO RELATED APPLICATION

The present application claims the benefit of U.S. Provisional Patent Application Ser. No. 60/793,247 filed Apr. 20, 2006 entitled "Pump Housing For a Domestic Appliance."

BACKGROUND OF THE INVENTION

1. Field of the Invention

The present invention pertains to the art of domestic appliances and, more particularly, to a domestic appliance including a pump having a pump housing that is over-molded with a plurality of resilient members.

2. Discussion of the Prior Art

Incorporating pumps into domestic appliances, such as dishwashers, washing machines and the like is widely known. In general, the pumps are employed to generate a flow of liquid, typically washing fluid, to clean laundry, dishes and the like. The pumps are either unidirectional, i.e., the liquid is simply pumped from a tub as in the case of a conventional washing machine, or bi-directional, i.e., the liquid is recirculated in the tub as in the case of a dishwasher. Regardless of the particular type, pumps are generally connected to the tub using a resilient hose connection. That is, in order to minimize vibrations transmitted between the pump and the tub, as well as to provide a simple method of connection, the pump is coupled to the tub through a resilient hose.

Often times, the hose will include sharp bends in order to accommodate various connection points. More specifically, as appliances become more and more sophisticated, room within the appliance to accommodate various components is reduced. Thus, often times, the hose is required to include a sharp bend in order to reach between the pump and the tub. In any case, hose clamps are used to secure the hose to both the pump and the tub. That is, a clamp is provided at each attachment point, i.e., at both the pump and the tub, in securing the hose so as to prevent any leaks.

While manufacturers have employed resilient hoses for some time, certain drawbacks in their use exist. More specifically, hoses, having multiple connections, create the potential for multiple leak points. In addition, mounting and installing multiple connections increases the overall cost and complexity of manufacture. Moreover, the sharp bends created in the hoses create inefficiencies in fluid flow that require the pump to work harder.

Based on the above, despite the existence of pumps in the prior art, there still exists a need for an improved pump arrangement for use in a domestic appliance. More specifically, there exists a need for a pump assembly having minimal connection points that is easy to manufacture, install and service.

SUMMARY OF THE INVENTION

The present invention is directed to a domestic appliance including a frame, a tub that defines a wash chamber and a cover shiftably mounted relative to the tub for selectively closing the wash chamber. The appliance also includes a pump that establishes and directs a flow of washing fluid from the tub prior to and/or during a washing operation. In accordance with the invention, the pump includes a pump housing having a rigid main body portion that defines an inlet section and an outlet section, as well as a plurality of resilient members that are formed upon the rigid main body portion. The plurality of resilient members define an inlet nipple that is over-molded onto the inlet section and an outlet nipple that is over-molded onto the outlet section.

In further accordance with the invention, the rigid main body portion includes another or secondary outlet section that is over-molded with another resilient member or secondary outlet nipple. In addition, the rigid main body includes a mounting element for supporting the pump within the cabinet. Preferably, the mounting element also includes a resilient member or insulation grommet to minimize any transfer of vibration between the pump and the appliance. Most preferably, the inlet nipple, outlet nipple, secondary outlet nipple and insulation grommet are all interconnected through a plurality of resilient web members.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
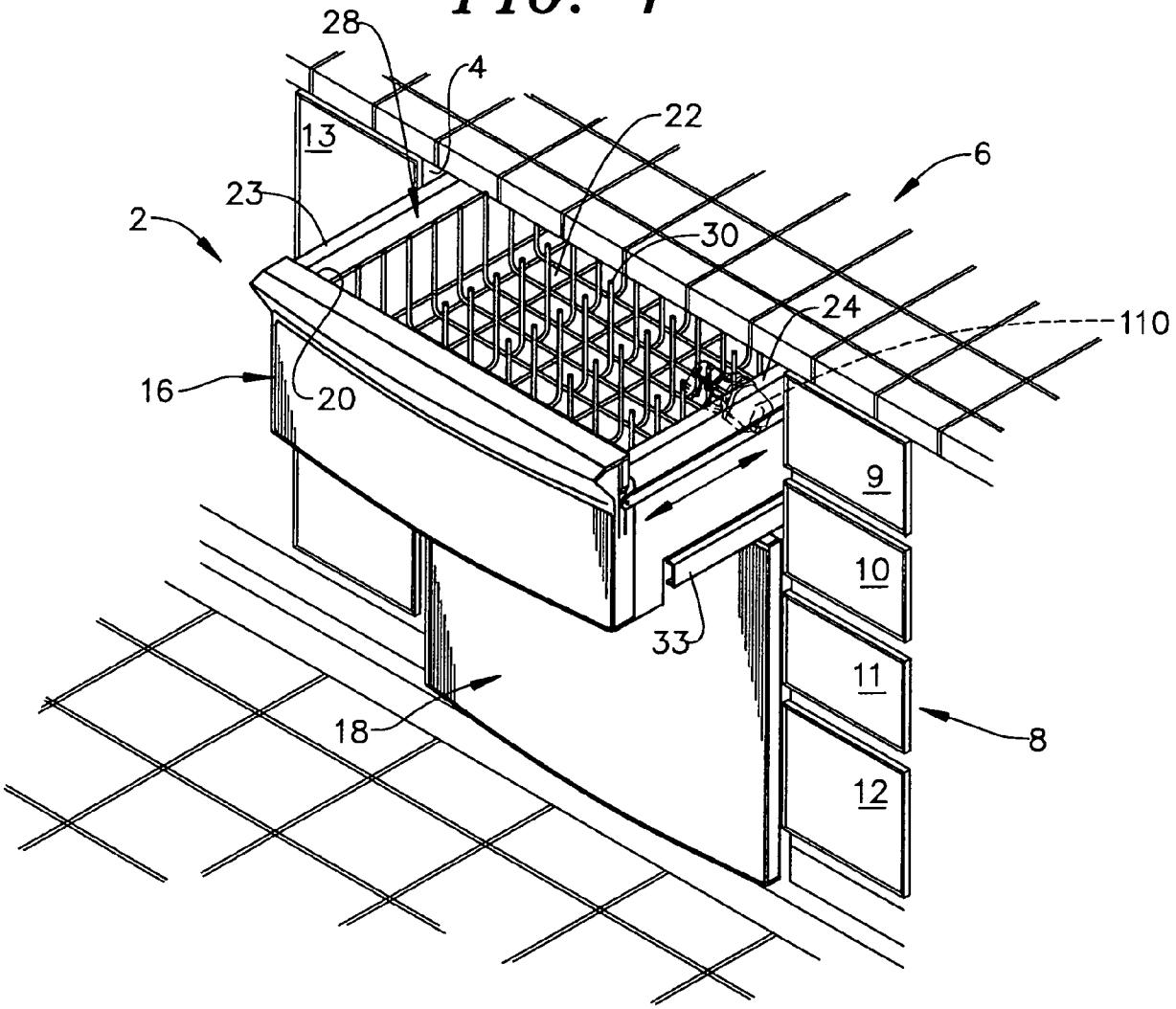
FIG. 1 is an upper, right perspective view of a domestic appliance shown in the form of a drawer-type dishwasher having a wash tub provided with a pump including a pump housing constructed in accordance with the present invention.
Figure 2:
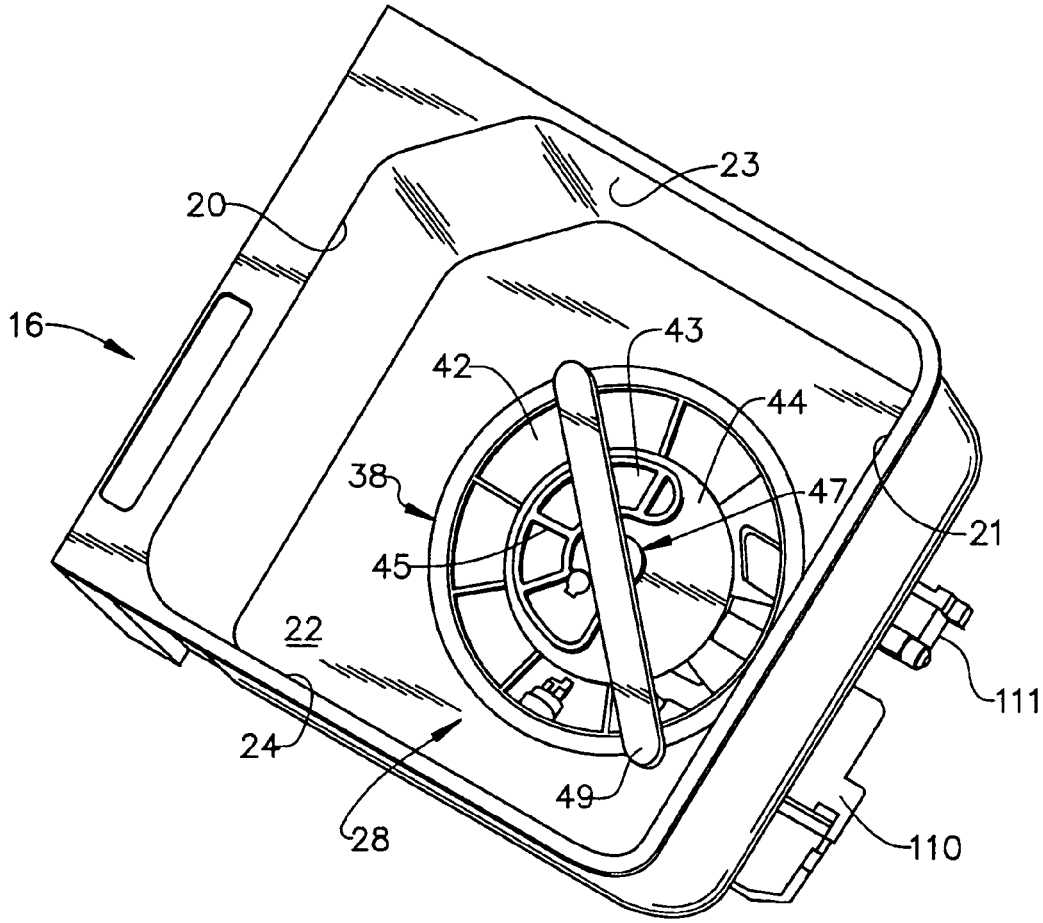
FIG. 2 is an upper perspective view of the wash tub provided with the pump housing constructed in accordance with the present invention.
Figure 3:
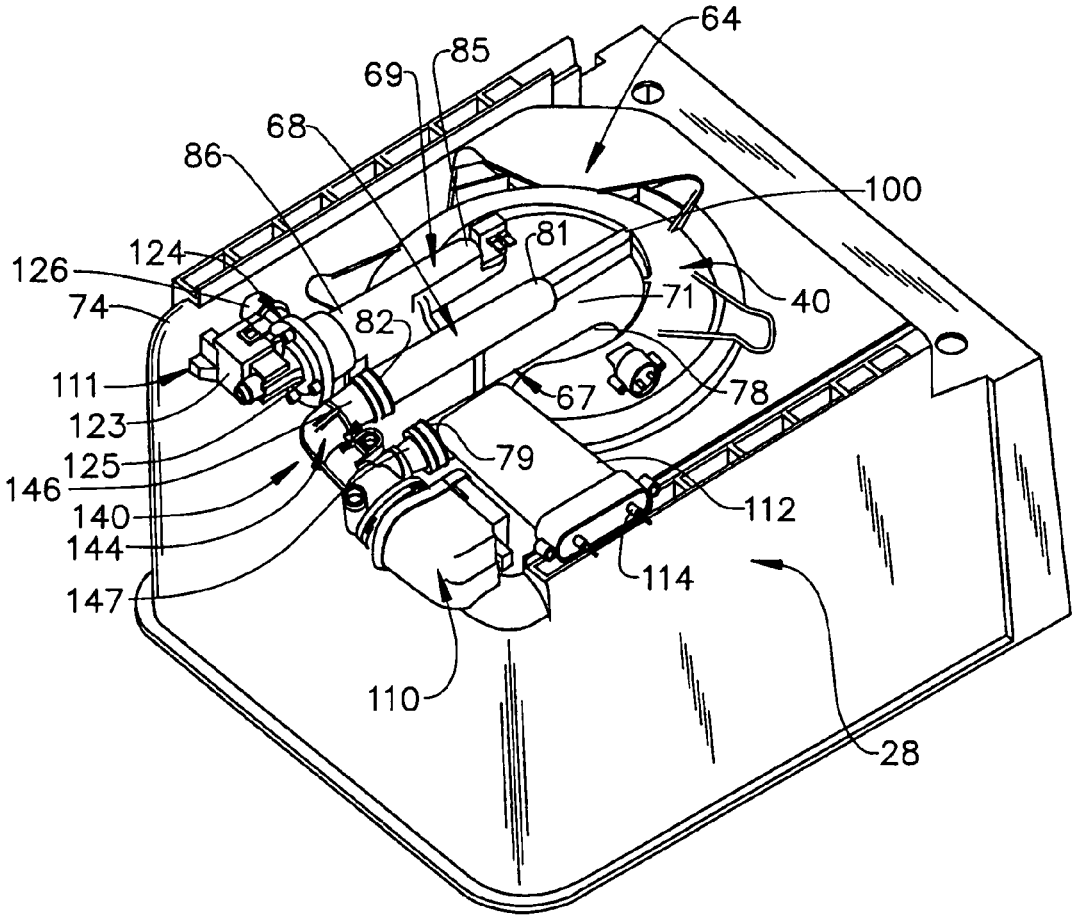
FIG. 3 is a lower perspective view of the tub of FIG. 2 illustrating the pump housing of the present invention.

With initial reference to FIGS. 1-3, a dishwasher constructed in accordance with the present invention is generally indicated at 2. As shown, dishwasher 2 includes a cabinet or outer housing 4 arranged below a kitchen countertop 6. Also below kitchen countertop 6 is shown cabinetry 8 including a plurality of drawers 9-12, as well as a cabinet door 13. Although the actual appliance into which the present invention may be incorporated can vary, the invention is shown in connection with dishwasher 2 depicted as a dual cavity dishwasher having an upper washing unit 16 and a lower washing unit 18.

Upper washing unit or, in accordance with the embodiment shown, drawer 16 includes a front wall 20, a rear wall 21, a bottom wall 22 and opposing side walls 23 and 24 that collectively define an upper wash tub or chamber 28. In a manner known in the art, wash tub 28 is provided with a dishrack 30 for supporting various objects, such as dishware, glassware, and the like, that are to be exposed to a washing operation. In a manner also known in the art, drawer 16 is slidingly supported within outer housing 4 through a pair of drawer support glides, one of which is indicated at 33.

As best shown in FIG. 2, drawer 16 includes a main filter housing 38 that is provided on bottom wall 22 within wash tub 28. Main filter housing 38 is actually positioned within a central, generally U-shaped, intake ring 40 (see FIG. 3) formed in bottom wall 22. In any event, main filter housing 38 includes a first or coarse radial strainer 42, a second or fine radial strainer 43 and a cover 44. Actually, second radial strainer 43 is part of a fine particle filter chamber (not shown) that includes a fine mesh filter screen (not separately labeled) provided within each of a plurality of large, radial spaced, openings 45 arranged about cover 44. In addition to filtering, main filter housing 38 also serves as a platform for a hub member 47 that extends through cover 44 and provides support for a wash arm 49. In a manner known in the art, wash arm 49 directs a flow of washing fluid onto kitchenware supported upon dishrack 30 during a washing operation. Drawer 16 also serves as a mounting platform for a sump 64, as well as various other wash system components as will be detailed more fully below.

With particular reference to FIG. 3, sump 64 includes a plurality of fluid conduits 67-69 provided along bottom wall 22 of wash tub 28. In the embodiment shown, fluid conduit 67 constitutes a wash fluid supply conduit, fluid conduit 68 constitutes a wash fluid recirculation conduit and fluid conduit 69 constitutes a wash fluid drain conduit so that each of fluid conduits 67-69 provide washing fluid flow management during various portions of a washing operation. Preferably, fluid conduits 67-69 are spaced from one another across bottom wall 22 and extend from within a central portion 71 of intake ring 40 to an outer, rear, edge portion 74 of wash tub 28. In the embodiment shown, fluid conduits 67-69 are arranged substantially parallel one another, however, it should be readily recognized that various other arrangements could also be employed.

In any event, supply conduit 67 is shown to include a first end 78, fluidly connected to wash arm 49, leading to a second end 79. Likewise, recirculation conduit 68 extends from a first end 81 positioned substantially centrally within intake ring 40 to a second end 82. Finally, drain conduit 69 extends from a first end 85 that is in fluid communication with main filter housing 38 to a second end 86. Sump 64 also includes a drain channel 100 that extends between first end 81 of fluid conduit 68 and intake ring 40. Drain channel 100 is provided to decrease an overall time required to perform a drain operation.

As indicated above, in addition to managing and filtering the flow of washing fluid in dishwasher 2, sump 64 serves as a mounting platform for various wash system components. More specifically, sump 64 supports a wash pump 110 a drain pump 111 and a heater 112 which is preferably mounted within a housing 114. In the embodiment shown, drain pump 111 includes a drain motor housing 123 and a drain pump housing 124. Drain pump housing 124 includes an inlet port 125 and an outlet port 126 that is adapted to interconnected to a drain hose (not shown). Inlet port 125 is preferably provided with a chopping mechanism (not shown) for macerating food particles before being expelled with the wash fluid from wash tub 28 during periodic drain or purging operations. However, it should be readily understood by those skilled in the art that drain pump 111 is but one option for locating the chopping mechanism and that various other positions are also acceptable. In any event, the structure described above has been provided for the sake of completeness as the present invention is particularly directed to the construction and method of forming a pump housing 140 for wash pump 110.

Figure 4:
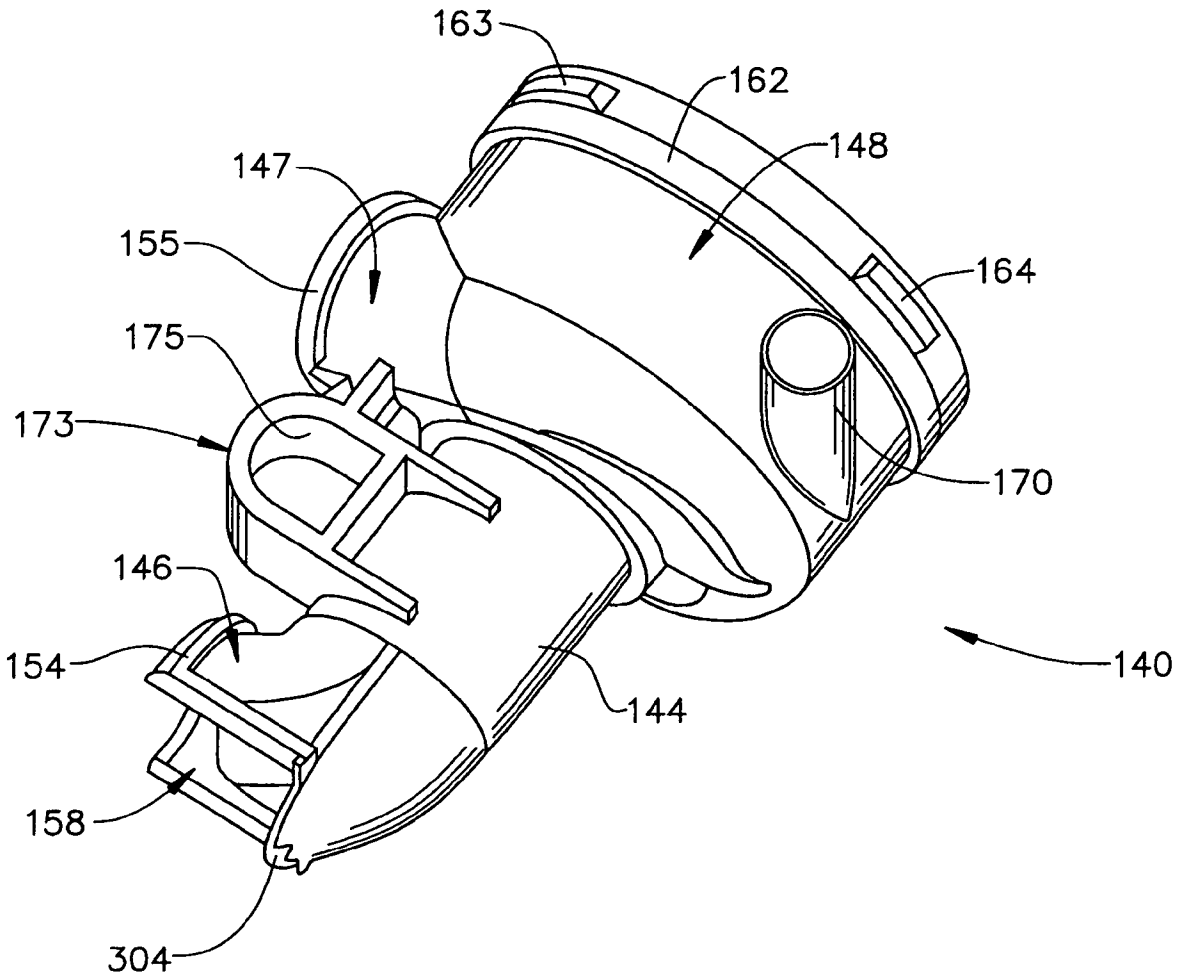
FIG. 4 is a perspective view of a rigid main body portion of the pump housing illustrated in FIG. 3.

As best shown in FIGS. 3 and 4, pump housing 140 includes a rigid main body portion 144 having an inlet section 146 and an outlet section 147 that are fluidly connected to an impeller section 148. Actually, outlet section 147 projects tangentially outward from impeller section 148. When operated, an impeller (not shown) draws washing fluid into inlet section 146, with the washing fluid being directed towards impeller section 148 and then radially outward through outlet section 147. Inlet section 146 is actually a recirculating inlet that receives a flow of washing fluid from tub 28 that is directed to a central portion of pump 110. Thus, in the embodiment shown, wash pump 110 receives the flow of washing fluid at a central portion of the impeller (not shown), then redirects the washing fluid radially through outlet section 147 and back towards wash arm 49 via conduit 67. In any event, inlet section 146 and outlet section 147 include corresponding lip portions 154 and 155. In addition, inlet section 146 is shown to include an open section 158 that, as will be detailed more fully below, aids in ensuring a smooth transition of washing fluid from inlet conduit 68 to pump 110. Finally, impeller portion 148 is shown to include a lip portion 162 that is provided with a plurality of lugs, one of which is indicated at 163, that ensure positive retention of pump housing 140 to a motor (not shown) provided as part of wash pump 110.

In the embodiment shown, in addition to outlet or discharge section 147, pump housing 140 also includes a secondary outlet or discharge section 170 that leads to, for example, an upper wash arm or other spray developing device (not shown). In a manner similar to that employed in connection with outlet section 147, secondary discharge 170 projects outward from impeller portion 148 so as to receive a radial flow of washing fluid. Finally, pump housing 140 is also shown to include a mounting element 173 having a central opening 175 that is adapted to receive a fastening device (not shown) to secure pump housing 140 to bottom portion 22 of drawer 16.

Figure 5:
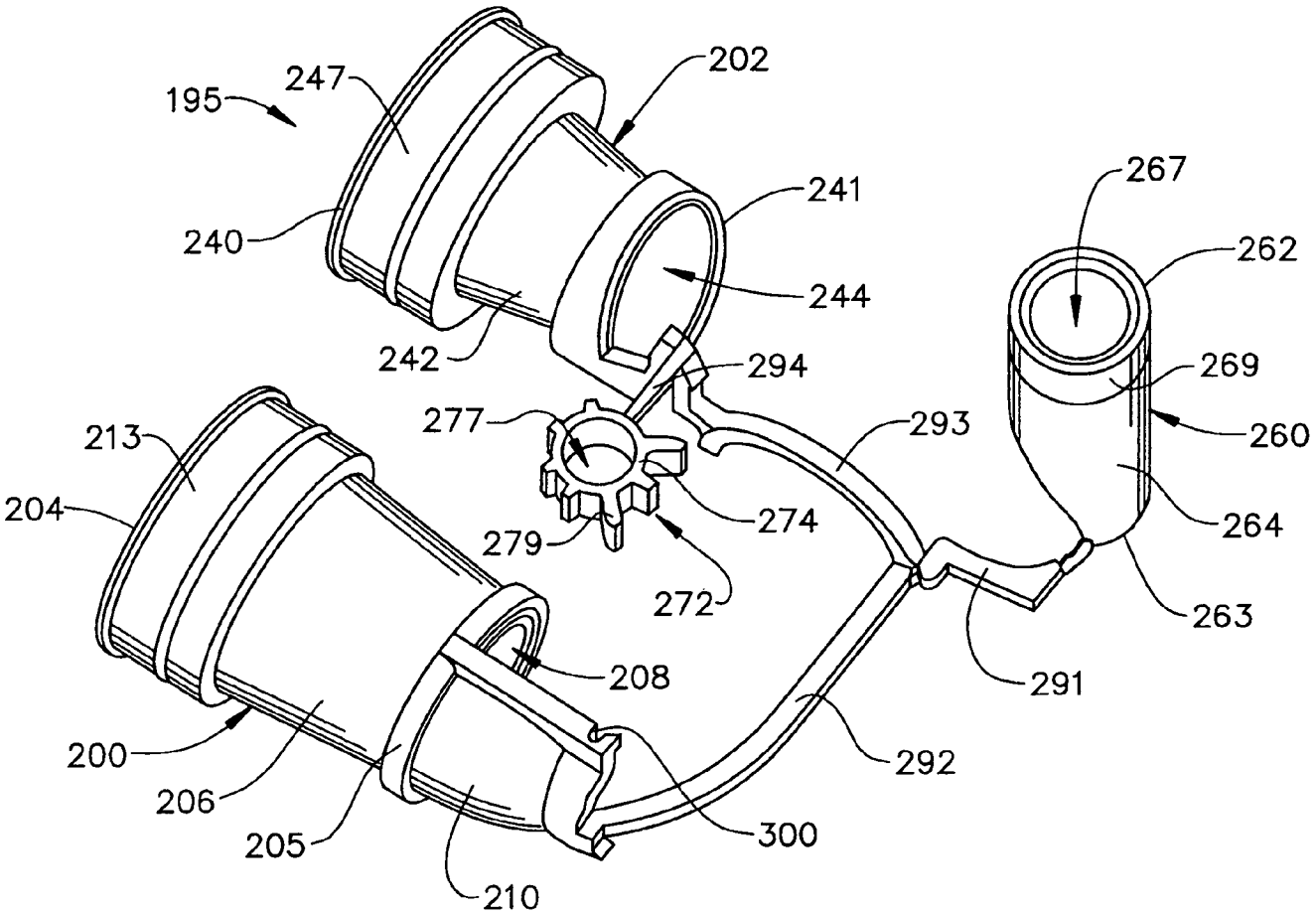
FIG. 5 is a perspective view of a plurality of interconnected resilient members before being over-molded onto the rigid main body portion of FIG. 4.
Figure 6:
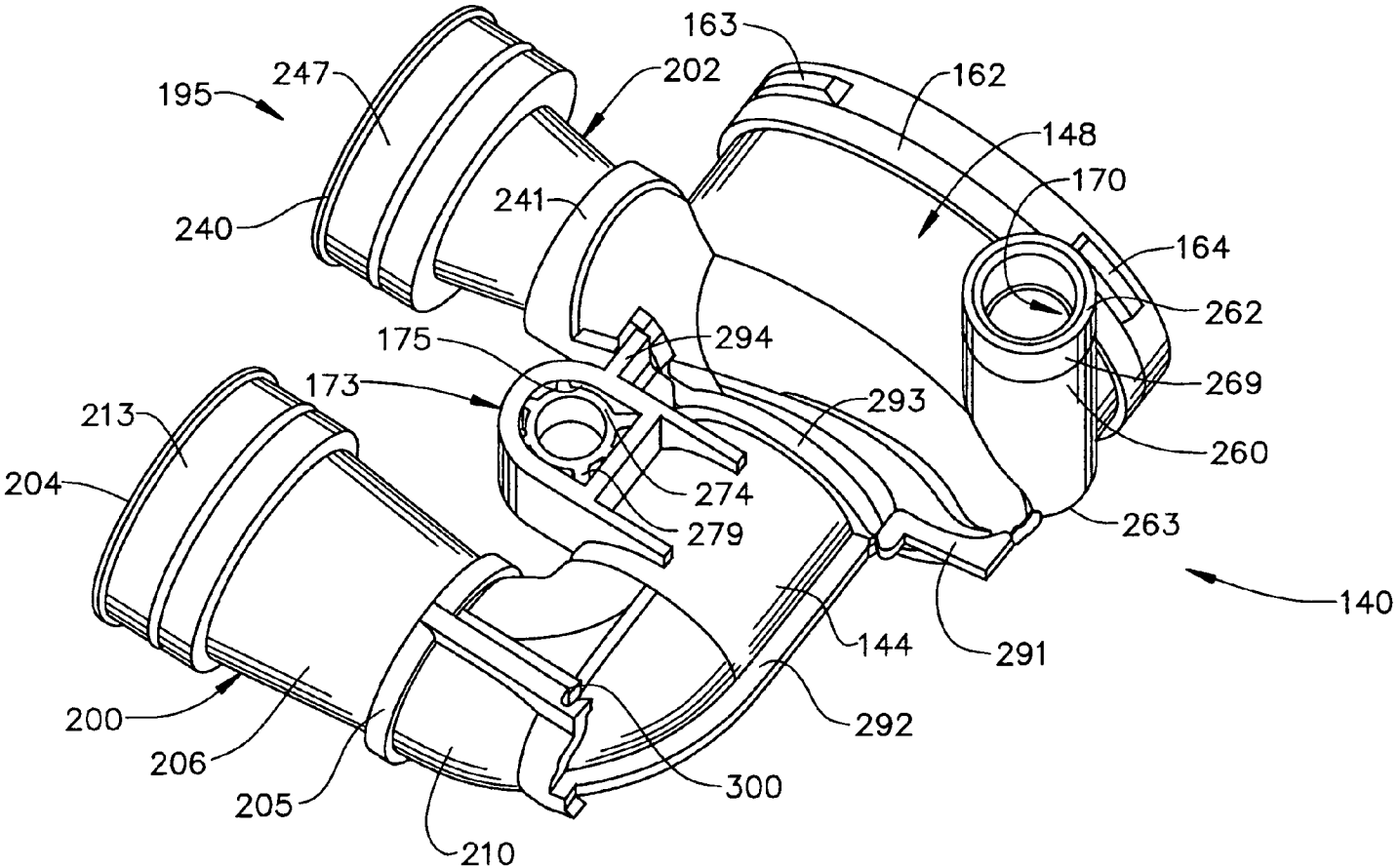
FIG. 6 is a perspective view of the rigid main body portion of FIG. 4 over-molded with the plurality of resilient members of FIG. 5.

In accordance with a preferred form of the invention, in order to provide a positive connection between pump housing 140 and plurality conduits 67 and 68, rigid main body portion 144 is over-molded with a plurality of resilient members 195. As best shown in FIG. 5, the plurality of resilient members 195 include an inlet nipple 200 and an outlet nipple 202. In accordance with the invention, inlet nipple 200 includes a first end section 204 that leads to a second end section 205 through an intermediate section 206 which collectively define a central passage 208. Inlet nipple 200 is also shown to include an extended region 210 which covers open section 158 of inlet section 146. Extended region 210 is provided with a slight radius to ensure a smooth transition of washing fluid from washing chamber 28 towards wash pump 110 so as to minimize any losses of fluid pressure. Finally, inlet nipple 200 is shown to include a clamping section 213 which extends radially about first end section 204. Clamping section 213 is sized so as to receive a clamp that secures inlet nipple 200 to second end 82 of conduit 68.

In a similar manner, outlet nipple 202 includes a first end section 240 that leads to a second end section 241 through an intermediate portion 242 which collectively define a central passage 244. First end section 240 is also provided with a clamping section 247 that is adapted to receive a clamp (not shown) to secure outlet nipple 202 to second end section 79 of conduit 67. That is, in accordance with the invention, when over-molded onto rigid main body portion 144, inlet nipple 200 and outlet nipple 202 serve as an interface between conduits 67 and 68 and wash pump 110. Preferably, inlet nipple 200 and outlet nipple 202 are formed from a resilient material, such as SANTOPRENE, that minimizes vibration transfer between wash pump 110 and washing chamber 28.

In further accordance with the invention, resilient members 195 further include another outlet or secondary discharge nipple 260 having a first end section 262 that leads to a second end section 263 through an intermediate section 264 which collectively define a central passage 267. In a manner similar to that described above, secondary discharge nipple 260 includes a clamping region 269 that is adapted to receive a clamp (not shown) to secure secondary discharge nipple 260 to a fluid conduit (also not shown) that leads into washing chamber 28. Finally, resilient members 195 preferably include an insulation grommet 272 having a central ring 274 that defines a central aperture 277. Ring 274 also includes a plurality of isolation fingers, one of which is indicated at 279, which, as will be discussed more fully below, also serve to minimize the transmission of vibrations between wash pump 110 and washing chamber 28. In the most preferred form of the invention, the plurality of resilient members 195 are interconnected through a plurality of web members 291-294.

As discussed above, resilient members 195 are over-molded onto rigid main body portion 144 of pump housing 140. More specifically, inlet nipple 200 is over-molded onto inlet section 146, and outlet nipple 202 is over-molded onto outlet section 147. Preferably, in order to ensure a secure attachment, inlet nipple 200 and outlet nipple 202 are over-molded onto lip portions 154 and 155 respectively. Moreover, extended region 210 is provided with a notched section 300 that cooperates with an additional lip region 304 provided adjacent open section 158. In a similar manner, secondary discharge nipple 260 is over-molded onto secondary discharge outlet 170 and isolation grommet 272 is positioned within mounting element 173. That is, isolation fingers 279 of isolation grommet 272 position ring 274 within central opening 175. In this manner, a mechanical fastener (not shown) is inserted through aperture 277 and secured to drawer 16, with grommet 272 ensuring that vibrations are not transferred between drawer 16 and wash pump 110.

Figure 7:
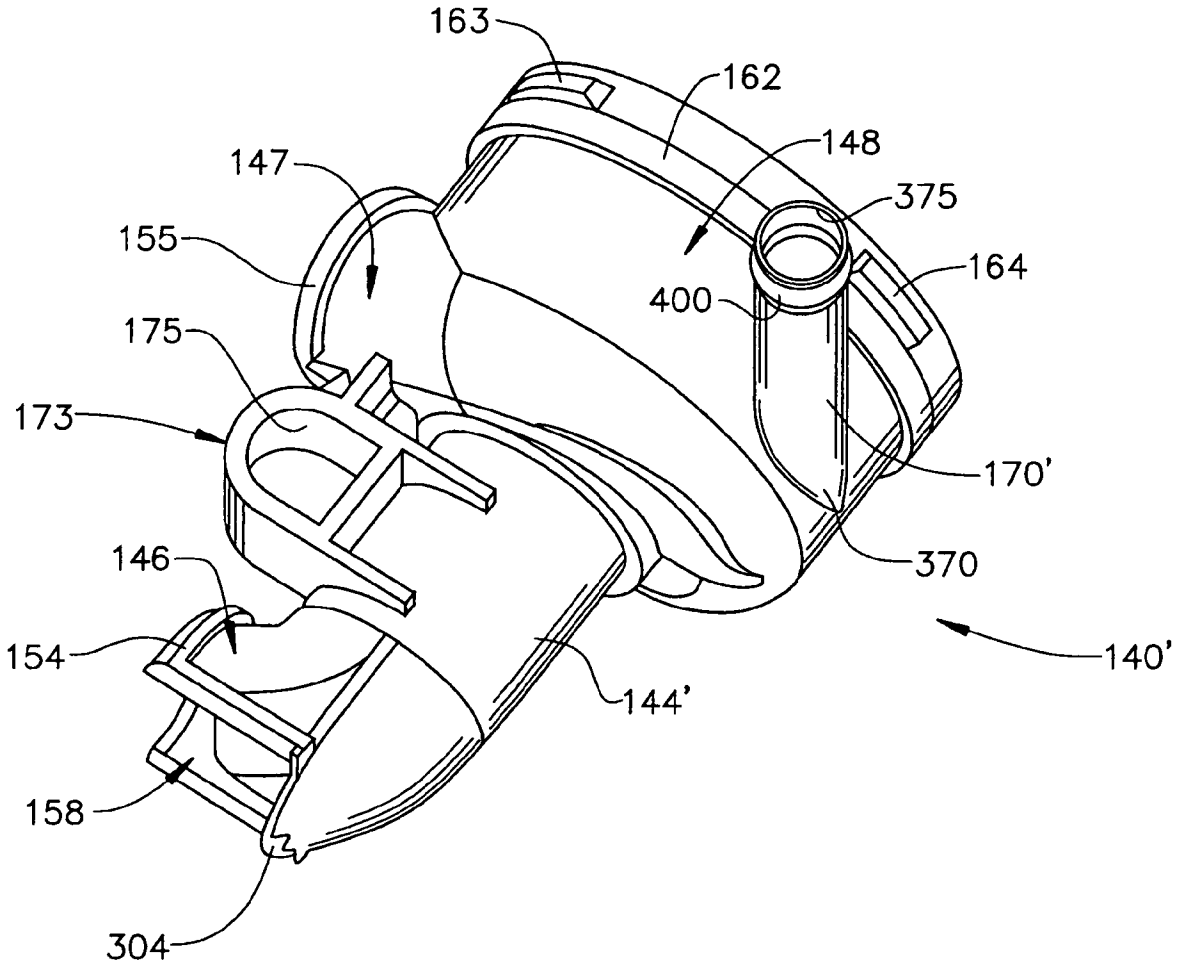
FIG. 7 is a perspective view of a rigid main body portion constructed in accordance with a second embodiment of the present invention.
Figure 8:
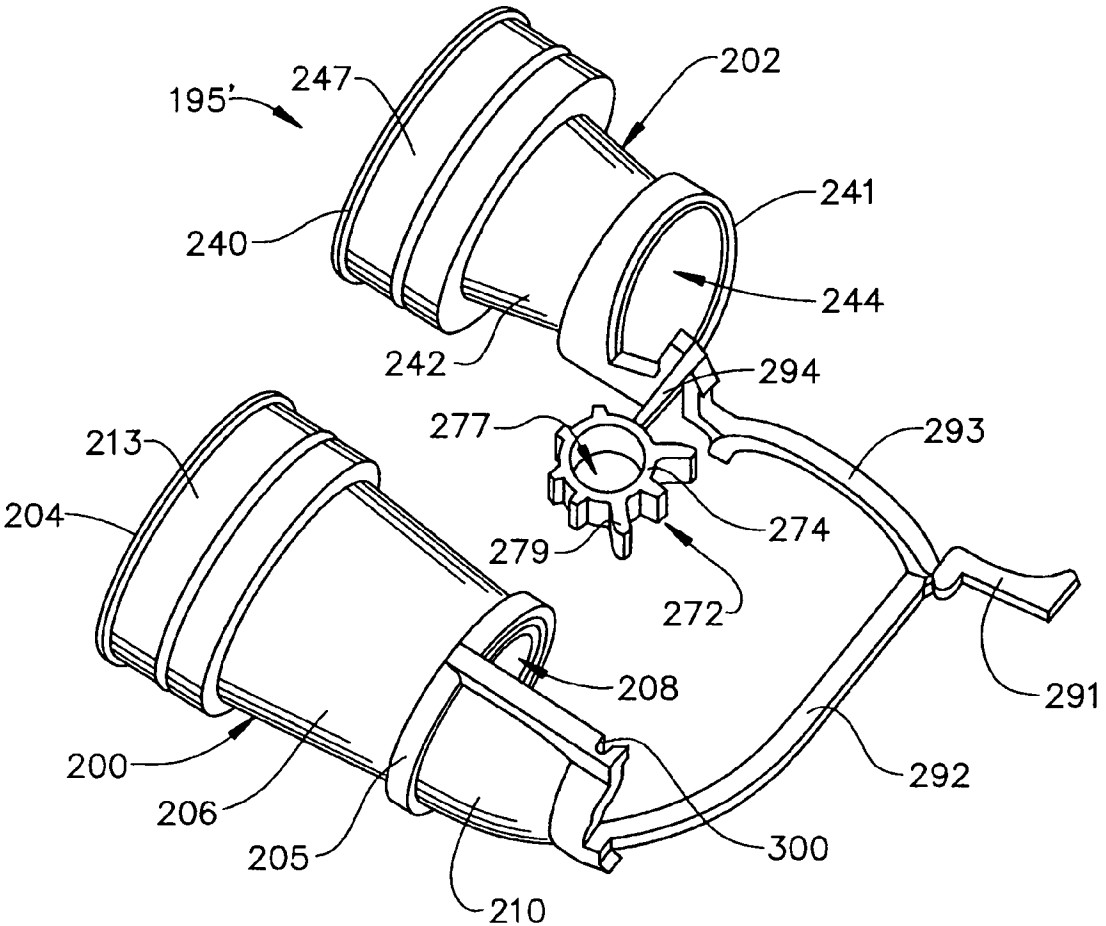
FIG. 8 is a perspective view of a plurality of interconnected resilient members constructed in accordance with the second embodiment before being over-molded into the rigid main body of FIG. 7.
Figure 9:
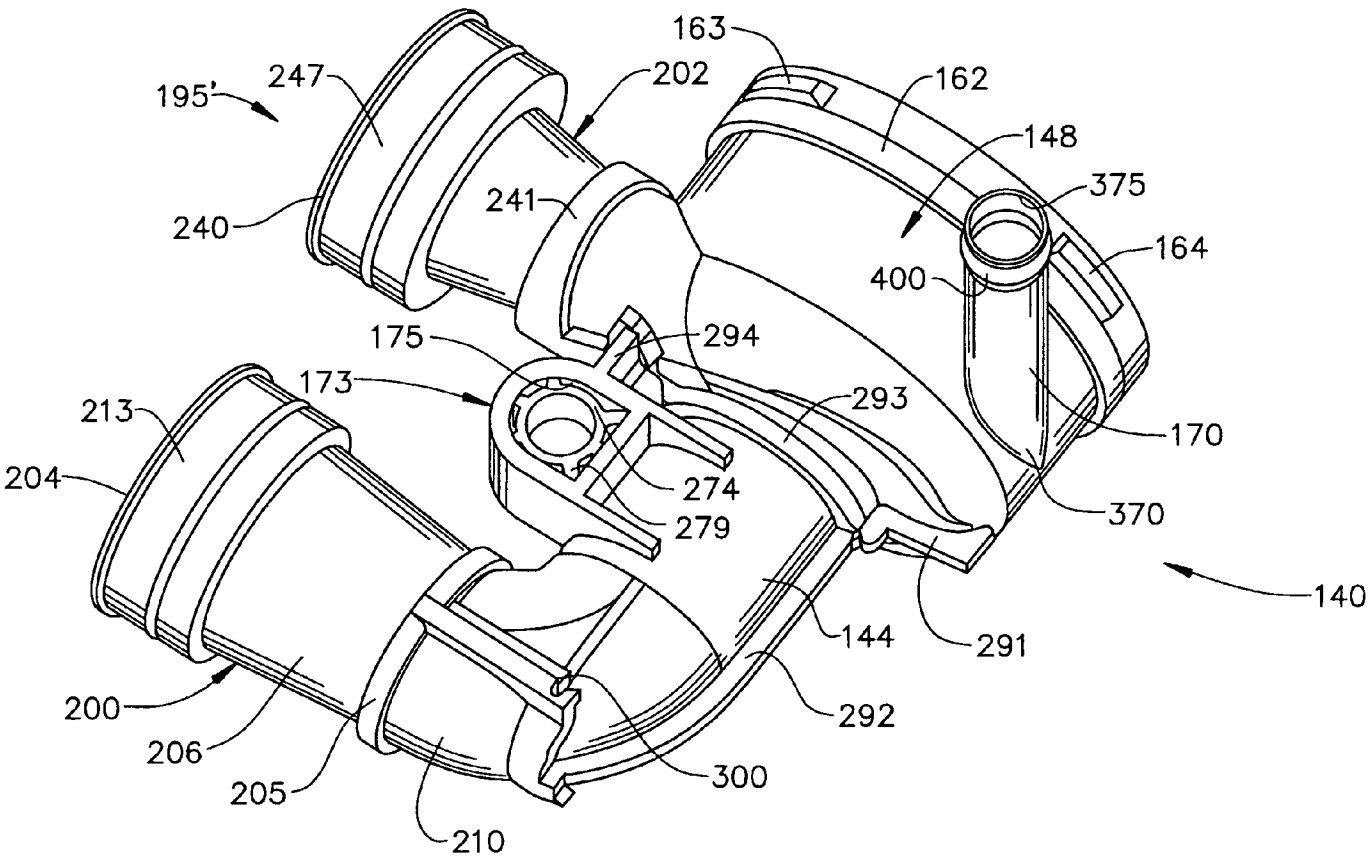
FIG. 9 is a perspective view of the rigid main body portion of FIG. 7 over-molded with the plurality of resilient members of FIG. 8.

Reference will now be made to FIGS. 7-9, where like reference numbers represent corresponding parts in the respective views describing a second embodiment of the present invention. As best shown in FIG. 7, a pump housing 140' constructed in accordance with the second embodiment of the present invention includes rigid main body portion 144' having a secondary discharge outlet 170' including a first end 370 that extends from impeller portion 148 towards a second end 375. An annular rib or raised area 400 extends about secondary discharge outlet 170' adjacent second end 375. Annular rib 400 provides structure that retains a hose (not shown) connected to secondary discharge outlet 170' and leads to washing tub 28. With this particular arrangement, secondary discharge outlet 170' does not require secondary discharge nipple 260. Thus, as shown in FIG. 8, secondary discharge nipple 260 is not included with inlet nipple 200 and outlet nipple 202 when forming the plurality of resilient members 195' constructed in accordance with the second embodiment. In any case, in a manner similar to that described above, once formed, resilient members 195' are over-molded onto rigid main body portion 144' of pump housing 140 as illustrated in FIG. 9.

At this point, it should be recognized that the present invention provides for a simple, cost effective means of fabricating a pump housing for a domestic appliance that minimizes any sharp bends that may lead to pump inefficiencies and eliminates the need for multiple hose clamps. That is, the present invention requires but a single hose clamp at each connection point to secure pump housing 140 to conduits 67 and 68, instead of multiple hose clamps as would typically be required.

Although described with reference to preferred embodiments of the invention, it should be readily understood that various changes and/or modifications can be made to the invention without departing from the spirit thereof. For instance, although shown in connection with a drawer-type dishwasher, the present invention can be incorporated into conventional dishwashers, as well as laundry appliances. In general, the invention is only intended to be limited by the scope of the following claims.

I claim:

1. A method of forming a wash pump assembly for a domestic appliance comprising:

molding a rigid main body portion having an inlet section and an outlet section;

and over-molding a plurality of resilient members onto portions of the rigid main body portion, said plurality of resilient members including at least an inlet nipple over-molded onto the inlet-section and an outlet nipple over-molded onto the outlet section, with the inlet nipple and outlet nipple interconnected through at least one over-molded resilient web member, even upon over-molding the plurality of resilient members onto the rigid main body.

2. The method of claim 1, further comprising: forming a mounting element on the rigid main body.

3. The method of claim 2, further comprising: positioning an insulation grommet in the mounting element, said insulation grommet constituting one of the plurality of resilient members.

4. The method of claim 3, further comprising: interconnecting the insulation grommet to the inlet nipple and the outlet nipple through a plurality of resilient web members.

5. The method of claim 4, further comprising: retaining the insulation grommet interconnected to the inlet nipple and the outlet nipple through the plurality of resilient web members upon over-molding the plurality of resilient members onto the rigid main body.

6. The method of claim 3, further comprising: forming another outlet section on the rigid main body.

7. The method of claim 6, further comprising: forming an annular rib on an end portion of the another outlet section.

8. The method of claim 6, further comprising: forming the plurality of resilient members with another outlet nipple, said another outlet nipple being over-molded onto the another outlet section.

9. The method of claim 8, further comprising: interconnecting the inlet nipple, outlet nipple, insulation grommet and another outlet nipple through a plurality Of resilient web members.

10. The method of claim 9, further comprising: retaining the insulation grommet interconnected to the inlet nipple and the outlet nipple through the plurality of resilient web members upon over-molding the plurality of resilient members onto the rigid main body.

11. The method of claim 1, further comprising: mounting the rigid main body portion over-molded with the plurality of resilient members in a drawer-type dishwasher.

* * * * *

UNITED STATES PATENT AND TRADEMARK OFFICE

CERTIFICATE OF CORRECTION

PATENT NO. : 8,034,276 B2
APPLICATION NO. : 11/716001
DATED : October 11, 2011
INVENTOR(S) : Rodney M. Welch It is certified that error appears in the above-identified patent and that said Letters Patent is hereby corrected as shown below:

Col. 6, lines 52-55, Claim 9: "The method of claim 8, further comprising: interconnecting the inlet nipple, outlet nipple, insulation grommet and another outlet nipple through a plurality Of resilient web members." - should be Claim 9: --The method of claim 8, further comprising: interconnecting the inlet nipple, outlet nipple, insulation grommet and another outlet nipple through a plurality of resilient web members.--

Signed and Sealed this
Twenty-eighth Day of August, 2012

David J. Kappos

David J. Kappos
*Director of the United States Patent and Trademark Office*